US009718283B2

(12) United States Patent
Ohnishi

(10) Patent No.: US 9,718,283 B2
(45) Date of Patent: Aug. 1, 2017

(54) INKJET PRINTING DEVICE AND INKJET PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/655,054

(22) PCT Filed: Dec. 16, 2013

(86) PCT No.: PCT/JP2013/083677
§ 371 (c)(1),
(2) Date: Jun. 24, 2015

(87) PCT Pub. No.: WO2014/103782
PCT Pub. Date: Jul. 3, 2014

(65) Prior Publication Data

US 2015/0343796 A1 Dec. 3, 2015

(30) Foreign Application Priority Data

Dec. 25, 2012 (JP) ..... 2012-281642

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 11/002
See application file for complete search history.

(56) References Cited

U.S. PATENT DOCUMENTS 6,382,759 B2 * 5/2002 Maeda ..... B41J 2/0454 347/17
6,390,618 B1 * 5/2002 Wotton ..... B41J 11/002 347/102
6,454,402 B1 * 9/2002 Koitabashi ..... B41J 2/2114 347/100
6,764,174 B2 * 7/2004 Sekiya ..... B41J 2/155 347/102

(Continued)

FOREIGN PATENT DOCUMENTS

JP 10-278243 10/1998
JP 2002137375 5/2002

(Continued)

OTHER PUBLICATIONS

"International Search Report (Form PCT/ISA/210)", mailed on Jan. 21, 2014, with English translation thereof, pp. 1-3.

(Continued)

*Primary Examiner* — Stephen Meier
*Assistant Examiner* — John P Zimmermann
(74) *Attorney, Agent, or Firm* — Jianq Chyun IP Office

(57) ABSTRACT

The invention has an object to provide a high-quality print. To achieve the object, an inkjet printing device (100) includes: a transferring roller, a print-heater (6) for heating a medium (20); and an after-heater (7) for heating an ink, wherein the device has a plurality of inkjet heads, and the plurality of inkjet heads discharges inks in different colors and are aligned along a direction of transfer of the medium.

1 Claim, 2 Drawing Sheets

(56) References Cited

U.S. PATENT DOCUMENTS

| | | | | |
|---|---|---|---|---|
| 6,957,886 | B2 * | 10/2005 | Alfekri | B41J 11/0015 347/100 |
| 7,150,521 | B2 * | 12/2006 | Sekiya | B41J 2/1433 347/100 |
| 7,216,968 | B2 * | 5/2007 | Smith | B41J 3/60 271/193 |
| 2004/0252173 | A1 * | 12/2004 | Ben-Zur | D06P 5/001 347/101 |
| 2006/0284906 | A1 * | 12/2006 | Jeong | B41J 2/15 347/5 |
| 2010/0149297 | A1 * | 6/2010 | Kanada | B41J 2/175 347/102 |
| 2012/0062640 | A1 * | 3/2012 | Uraki | B41J 2/15 347/18 |

FOREIGN PATENT DOCUMENTS

| | | |
|---|---|---|
| JP | 2004-195996 | 7/2004 |
| JP | 2008024829 | 2/2008 |
| JP | 2008-162097 | 7/2008 |
| JP | 2010-030313 | 2/2010 |
| JP | 2012171237 | 9/2012 |
| JP | 2012214009 | 11/2012 |

OTHER PUBLICATIONS

"Office Action of Japan Counterpart Application" with English translation, issued on Aug. 9, 2016, p. 1-p. 5.
"Search Report of Europe Counterpart Application", issued on Feb. 15, 2017, p. 1-p. 5.
"Office Action of Japan Counterpart Application" with English translation thereof, issued on Mar. 21, 2017, p1-p5.

* cited by examiner

INKJET PRINTING DEVICE AND INKJET PRINTING METHOD

CROSS-REFERENCE TO RELATED APPLICATION

This application is a 371 application of international PCT application serial no. PCT/JP2013/083677, filed on Dec. 16, 2013, which claims the priority benefit of Japan application no. JP 2012-281642, filed on Dec. 25, 2012. The entirety of each of the above-mentioned patent applications is hereby incorporated by reference herein and made a part of this specification.

TECHNICAL FIELD

The present invention relates to an inkjet printing device and an inkjet printing method.

BACKGROUND ART

Patent Document 1 describes a printer equipped with a pre-heater for preheating an unprinted medium, and a print-heater for heating the medium with an object just printed thereon.

PRIOR ART DOCUMENT

Patent Document

Patent Document 1: Japanese Patent Application Laid-Open No. 2010-30313 A (disclosed on Feb. 12, 2010).

SUMMARY OF THE INVENTION

Problems to be Solved by the Invention

The serial inkjet printer described in Patent Document 1 has an unsolved problem; smearing of ink discharged on the medium through an inkjet head may degrade the quality of a printed image.

The invention has been accomplished to solve this problem, and has an object to provide an inkjet printing device and an inkjet printing method by which high-quality printing is fulfilled.

Solutions to the Problems

To achieve the object, an inkjet printing device according to the invention includes: a transfer unit for transferring a print medium; an inkjet head for discharging an ink on the print medium to carry out a print job; a print-heater for heating the print medium, the print-heater being disposed so as to face a region where the ink is discharged through the inkjet head with the print medium interposed therebetween; and an after-heater for heating the ink discharged on the print medium, the after-heater being installed on a downstream side in a direction of transfer of the print medium relative to the print-heater, wherein the inkjet printing device includes a plurality of inkjet heads as the inkjet head, and the plurality of inkjet heads discharges the inks in different colors and is aligned in the direction of transfer.

The plural inkjet heads that respectively discharge the inks in different colors are aligned in the direction of transfer. These inkjet heads thus aligned in the direction of transfer discharge the respective inks in a sequential order on the print medium while being transferred. While one of the inkjet heads is discharging its ink on the print medium, the ink discharged and adhered to the print medium is heated by the print-heater. When another one of the inkjet heads starts to discharge its ink on the print medium, the ink previously discharged and adhered to the print medium has already been thickened to a given or higher degree of viscosity. This ink, therefore, has no chance of smearing. When the ink is discharged on the print medium through another one of the inkjet heads, therefore, bleeding between colors of the inks does not occur. Besides, heating the print medium by the print-heater serves to thicken the ink discharged later to a given or higher degree of viscosity before smearing of the ink starts. Thus, smearing of the inks discharged on the print medium is effectively prevented.

By preventing smearing of the discharged inks on the print medium, the inks on the print medium can provide a high-quality print.

Preferably, the inkjet printing device according to the invention is further characterized in that, of the plurality of inkjet heads, the inkjet heads that discharge the inks in any colors but black are arranged from an upstream side toward the downstream side in the direction of transfer, so that the inks in different colors are discharged through the inkjet heads in the order of lower clarity.

The plural inkjet heads discharge the inks in any colors but black in the order of lower clarity from the upstream side toward the downstream side in the direction of transfer of the print medium. Therefore, the ink of higher clarity is discharged on the ink of lower clarity. This prevents that incident light is reflected or absorbed by an ink surface alone, allowing the inks to exhibit their colors more vividly.

Preferably, the inkjet printing device according to the invention is further characterized in that the plurality of inkjet heads is at least four inkjet heads that are aligned along the direction of transfer, and the four inkjet heads are arranged from the upstream side toward the downstream side in the direction of transfer so as to respectively discharge cyan, magenta, yellow, and black inks in a sequential order.

The inkjet printing device thus characterized discharges the different color inks except the black ink in the order of lower clarity. This allows the inks to exhibit their colors more vividly. The plural inkjet heads may be spaced at intervals optionally decided depending on such factors as transfer speed of the print medium, types of used inks, type of the print medium, heating temperatures, and environmental temperature.

Preferably, the inkjet printing device according to the invention is further characterized in that the plurality of inkjet heads, facing the print medium, moves in a direction intersecting the direction of transfer, the plurality of inkjet heads is at least four inkjet heads, two of the four inkjet heads are aligned in the direction intersecting the direction of transfer, other two of the four inkjet heads are located on the upstream side in the direction of transfer relative to the two of the four inkjet heads aligned in the direction intersecting the direction of transfer, and the two of the four inkjet heads on the downstream side in the direction of transfer respectively discharge the yellow and black inks.

By disposing two of the inkjet heads in the direction intersecting the direction of transfer, the serial head inkjet printing device can be compactly structured as compared to disposing plurality of the inkjet heads along the direction of transfer.

An inkjet printing method according to the invention includes: a transfer step of transferring a print medium; a print step of discharging an ink on a print medium through an inkjet head to carry out a print job; a first heating step of heating the print medium facing a region where the ink is discharged through the inkjet head; and a second heating step of heating the ink on the print medium transferred subsequent to the first heating step, wherein a plurality of inkjet heads is provided as the inkjet head, and the plurality of inkjet heads discharges the inks in different colors and is aligned in a direction of transfer of the print medium.

The inkjet printing method according to the invention provides similar technical advantages to those provided by the inkjet printing device according to the invention.

Effects of the Invention

The inkjet printing device and the inkjet printing method according to the invention can both advantageously fulfill high-speed and high-quality printing.

EMBODIMENTS OF THE INVENTION

First Embodiment

Figure 1:
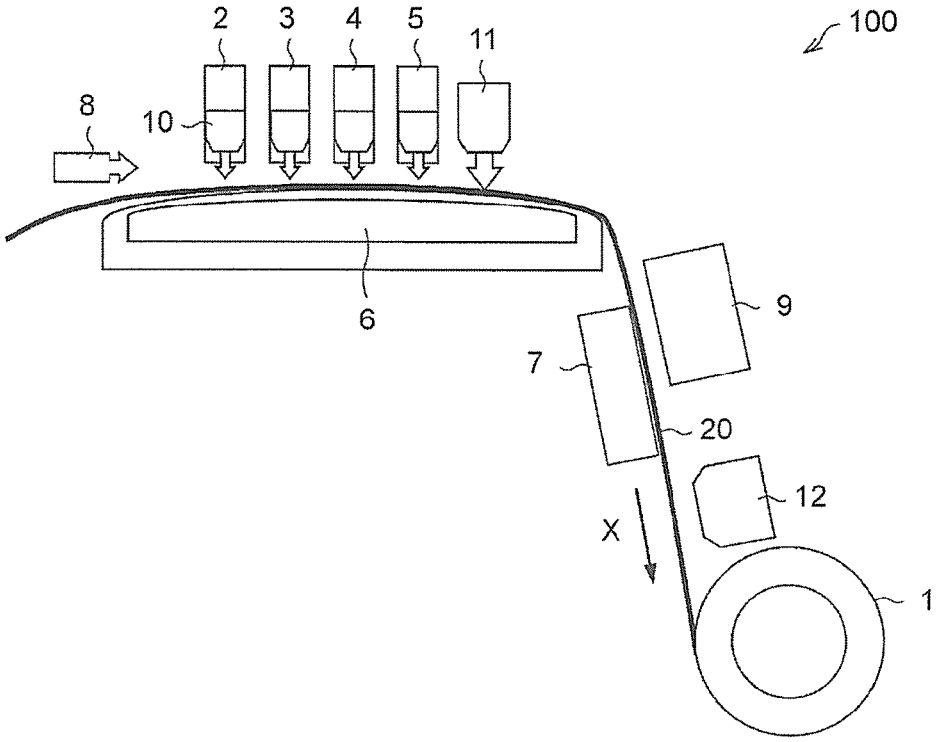
FIG. 1 is a drawing of an inkjet printing device according to an embodiment of the invention.

An embodiment of the invention is hereinafter described in detail referring to FIG. 1. FIG. 1 is a drawing of an inkjet printing device according to the embodiment.

[Inkjet Printing Device 100]

An inkjet printing device 100 according to the embodiment includes: a transferring roller (transferring unit, not illustrated) for transferring a medium (print medium) 20; inkjet heads 2 to 5 that respectively discharge inks on the medium 20 to carry out a print job; a print-heater 6 for heating the medium 20, the print-heater 6 being disposed so as to face a region where the inks are discharged through the inkjet heads 2 to 5 with the medium 20 interposed therebetween; and an after-heater 7 for heating the inks discharged on the medium 20, the after-heater 7 being installed on a downstream side in a direction of transfer of the medium 20 (direction indicated by arrow X in FIG. 1) relative to the print-heater 6. The plural inkjet heads 2 to 5 respectively discharge the inks in different colors and are aligned in the direction of transfer. The inkjet printing device 100 according to the embodiment further includes a take-up roll 1, a fan 8, ultraviolet emitting lamps 10 to 12, and a warm/hot air heater 9. If smearing of the inks can be prevented by the print-heater 6 alone, the ultraviolet emitting lamps 10 and 11 may be unnecessary.

The inkjet printing device 100 is configured to discharge inks on the medium 20 to obtain a print object inkjet-printed thereon. Examples of the inkjet printing device according to the invention are serial head inkjet printing device, and line head inkjet printing device. The printer of the former type has movable inkjet heads and discharges inks on a print medium through the heads moving in a direction intersecting a direction of transfer of the print medium. The printer of the latter type has relatively long and stationary inkjet heads and discharges inks through the heads on the print medium while being transferred.

[Transferring Roller]

The transferring roller for transferring the medium 20 is installed on the downstream or upstream side in the direction of transfer in vicinity of a region where the medium 20 is printed. By driving the transferring roller, the medium 20 is transferred by a frictional force generated by the roller.

[Take-Up Roll 1]

The take-up roll 1 winds the medium 20 around its outer periphery to retrieve the printed medium 20 in the form of a roll. The take-up roll 1 is located on the downstream side in the direction of transfer of the medium 20. By driving the take-up roll 1 in a manner that coordinates with the transferring roller, the medium 20 transferred by the transferring roller is prevented from slackening when wound around the take-up roll.

[Inkjet Heads 2-5]

The inkjet heads 2 to 5 discharge inks on the medium 20 to print an object thereon. The inkjet heads 2 to 5 discharge inks in different colors and are aligned in the direction of transfer of the medium 20.

According to the embodiment, the inkjet heads 2 to 5 are aligned along the direction of transfer of the medium 20 (direction indicated by arrow X in FIG. 1). The inkjet heads 2 to 5 are arranged from the upstream side toward the downstream side in the direction of transfer so as to respectively discharge cyan, magenta, yellow, and black inks in a sequential order. Specifically, the inkjet head 2 discharges the cyan ink, the inkjet head 3 discharges the magenta ink, the inkjet head 4 discharges the yellow ink, and the inkjet head 5 discharges the black ink.

According to the embodiment, of the plural inkjet heads, the inkjet heads 2 to 4 that discharge the color inks other than the black ink are preferably arranged from the upstream side toward the downstream side in the direction of transfer of the medium 20, so that the different color inks are discharged through these heads in the order of lower clarity. The inkjet printing device thus characterized discharges the different color inks except the black ink in the order of lower clarity, so that the inks of higher clarity are discharged on the inks of lower clarity. This prevents that incident light is reflected or absorbed by an ink surface alone, allowing the inks to exhibit their colors more vividly. The plural inkjet heads may be spaced at intervals optionally decided depending on such factors as transfer speed of the print medium, types of used inks, and type of the print medium, heating temperatures, and environmental temperature. For example, the inkjet heads may be spaced from one another by a distance that the slowest-drying ink among all the inks heated by the print-heater 6 described later can be dry enough not to smear, or the inter-head intervals may be variable depending on the properties of the discharged inks.

The inkjet head that discharges the black ink may be located on the upstream side or the downstream side relative to the other ink discharging jet heads.

Although the embodiment provides four inkjet heads, the inkjet printing device according to the invention has any number more than one of inkjet heads that respectively discharge different color inks. Optionally, the device may have a plurality of inkjet heads that discharge inks of the same color.

Examples of colors of the inks used in the inkjet heads according to the invention include, but are not limited to, regular colors such as cyan, magenta, yellow, and black, lightened colors of these regular colors, specific colors such as orange, green, white, metallic, and clear colors, and combinations of these colors.

[Print-Heater 6]

The print-heater 6 is installed so as to face the region where the inks are discharged through the inkjet heads 2 to 5 with the medium 20 interposed therebetween. The print-heater 6, by heating the medium 20, heats the inks discharged on the medium 20.

The print-heater 6 heats the inks on the medium 20 preferably at temperatures equal to or higher than 30° C. and equal to or lower than 90° C., and more preferably at temperatures equal to or higher than 40° C. and equal to or lower than 70° C. Heating the ink at temperatures equal to or higher than 40° C. allows a solvent contained in the ink to evaporate, increasing the viscosity of the ink in a short period of time, while heating the ink at temperatures equal to or lower than 70° C. can better control the occurrence of cockling with print media inferior in heat resistance, a material of which is, for example, vinyl chloride.

A pre-heater for heating the medium 20 may be further installed on the upstream side in the direction of transfer of the medium 20 relative to the print-heater 6. Preheating the medium 20 by the pre-heater can efficiently evaporate the solvent contained in the ink discharged on the medium 20. If using, as the medium 20, a print medium inferior in heat resistance, the print-heater 6 at high temperatures is likely to provoke the occurrence of cockling. However, preheating the medium 20 by the pre-heater makes high-temperature heating by the print-heater 6 unnecessary, effectively avoiding the occurrence of cockling.

[Ink]

The ink used in the inkjet printing device according to the invention contains a solvent and is curable by radiation irradiated thereon. For example, the ink contains at least one of curable monomers and curable oligomers that are polymerized by radiation irradiated thereon.

The ink is heated to volatilize the solvent and thereby increased in viscosity. Then, radiation is irradiated on the ink to polymerize at least one of curable monomers and curable oligomers. As used herein, "radiation" is a collective term for various kinds of particle beams and electromagnetic waves. An example of the particle beams is electron beam, while an example of the electromagnetic waves is ultraviolet. An example of inks of ultraviolet curing type is a solvent UV ink.

As used herein, "curable monomer" is a monomer that is polymerized under some kind of externally applied stimulus to form a cured resin, and "curable oligomer" is an oligomer that is polymerized under some kind of externally applied stimulus to form a cured resin. Examples of the curable monomer are monomers or oligomers of ultraviolet curing type which are cured by ultraviolet irradiated thereon (hereinafter, "ultraviolet" may be referred to as "UV"). Examples of the curable oligomers are monomers or oligomers of electron beam curing type which are cured by electron beam irradiated thereon. The curable monomers or curable oligomers polymerized and cured are increased in viscosity. Among the examples of radiation, the inkjet printing device 100 according to the embodiment irradiates ultraviolet emitted from the ultraviolet emitting lamps 10 to 12 described later. This is, however, a non-limiting example.

The ink used in the inkjet printing device according to the invention contains a solvent. The solvent-containing ink, when heated and evaporated, is increased in viscosity. Such a solvent-diluted ink is advantageous in that when UV is irradiated on the ink during the heating, its degree of cure is not as high as the other known UV inks. Thus, the degree of cure of the ink through the radiation, such as ultraviolet, is easily adjustable.

Examples of the solvent are glycol ethers and glycol ether acetates, including: propylene glycol monomethyl ether, ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, ethylene glycol monomethyl ether propionate, ethylene glycol monoethyl ether propionate, ethylene glycol monobutyl ether propionate, diethylene glycol monomethyl ether propionate, diethylene glycol monoethyl ether propionate, diethylene glycol monobutyl ether propionate, propylene glycol monomethyl ether propionate, dipropylene glycol monomethyl ether propionate, ethylene glycol monomethyl ether butyrate, ethylene glycol monoethyl ether butyrate, ethylene glycol monobutyl ether butyrate, diethylene glycol monomethyl ether butyrate, diethylene glycol monoethyl ether butyrate, diethylene glycol monobutyl ether butyrate, propylene glycol monomethyl ether butyrate, and dipropylene glycol monomethyl ether butyrate.

Other than the before-mentioned examples, the solvent may be a hydrocarbon-based solvent. Examples of the hydrocarbon-based solvent are n-hexane, n-heptane, n-octane, isooctane, cyclohexane, methylcyclohexane, benzene, toluene, o-xylene, m-xylene, p-xylene, and ethylbenzene.

Other than the before-mentioned examples, the solvent may be an ester-based solvent. Examples of the ester-based solvents are propyl formate, n-butyl formate, isobutyl formate, amyl formate, ethyl acetate, n-propyl acetate, isopropyl acetate, n-butyl acetate, isobutyl acetate, secondary butyl acetate, n-amyl acetate, isoamyl acetate, methyl isoamyl acetate, secondary hexyl acetate, methyl propionate, ethyl propionate, n-butyl propionate, methyl butyrate, ethyl butyrate, methyl lactate, and y-butyrolactone.

Other than the before-mentioned examples, the solvent may be a ketone-based solvent. Examples of the ketone-based solvents are methyl ethyl ketone, methyl-n-propyl ketone, methyl-n-butyl ketone, methyl isobutyl ketone, diethyl ketone, ethyl-n-butyl ketone, di-n-propyl ketone, and mesityl oxide.

The solvent contained in the ink for the inkjet printing device according to the invention is preferably at least one selected from the groups of exemplified solvents. Such a solvent can be efficiently evaporated by heating.

The solvent content for the whole quantity of the ink (solvent UV ink) may be optionally decided depending on intended uses. For example, the solvent content is preferably equal to or greater than 10 wt. %, and more preferably equal to or less than 55 wt. %. The solvent contained by a weight percentage within this range can be efficiently evaporated by heating.

[Fan 8]

The fan 8 blows air in the direction of transfer of the medium 20 to prevent that gas generated by evaporating the ink condenses, forming dew drops. As required, the fan 8 may be configured to blow hot air.

[Ultraviolet Emitting Lamps 10]

Each of the inkjet heads 2 to 5 has one of the ultraviolet emitting lamps 10. The ultraviolet emitting lamps 10 respectively irradiate ultraviolet on the inks discharged on the medium 20 through the inkjet heads 2 to 5, thereby curing the inks. If the heating by the print-heater 6 is sufficient for preventing smearing of the inks, the inkjet heads may need not be equipped with the ultraviolet emitting lamps 10.

The ink for the inkjet printing device according to the invention is curable by radiation irradiated thereon. The inks on the medium 20 can be cured by irradiating thereon ultraviolet emitted from the ultraviolet emitting lamps 10.

The ultraviolet emitting lamp 10 may be one selected from UV-LED lamps, metal-halide lamps, black light lamps, germicidal lamps, xenon lamps, and combinations of these lamps. A range of ultraviolet wavelengths when using a UV-LED lamp is, for example, 350 nm to 420 nm. An amount of ultraviolet irradiation is preferably decided within such a range of values that allows curing of the inks on the medium 20 to a smearing-preventable extent (semi-cured).

Through ultraviolet irradiation by the ultraviolet emitting lamps 10, the inks are preferably cured until their degrees of viscosity are equal to or greater than 200 mPa·sec. and equal to or less than 5,000 mPa·sec. The ink viscosity equal to or greater than 200 mPa·sec. provides the following advantages; smearing of the inks is prevented, and ink droplets on the medium 20 are spread enough to flatten the surface of a print. The ink viscosity equal to or less than 5,000 mPa·sec. can more effectively prevent smearing of the inks.

According to the embodiment, the different color inks discharged through the inkjet heads 2 to 5 can be cured, one each at a time, by the ultraviolet emitting lamps 10 installed in these inkjet heads. For example, the cyan ink discharged through the inkjet head 2 is cured by the ultraviolet emitting lamp 10 installed in the head 2. Then, the magenta ink discharged through the inkjet head 3 is cured by the ultraviolet emitting lamp 10 installed in the head 3. By thus curing each color ink at a time, the inks discharged on the medium 20 are very lustrous and improved in smoothness.

[Ultraviolet Emitting Lamp 11]

An ultraviolet emitting lamp 11 is installed adjacent to the inkjet head 5 in the direction indicated by arrow X. This ultraviolet emitting lamp is intended to irradiate ultraviolet on the inks on the medium 20 already ultraviolet-irradiated by the ultraviolet emitting lamps 10, thereby further curing the inks. If the heating by the print-heater 6 is sufficient for preventing smearing of the inks, the ultraviolet emitting lamp 11 may be unnecessary.

After ultraviolet is irradiated by the ultraviolet emitting lamps 10 on the inks on the medium 20, the transferring roller is driven to transfer the medium 20 in the direction indicated by arrow X. After ultraviolet is irradiated on the inks on the medium 20 by the ultraviolet emitting lamps 10, ultraviolet emitted from the ultraviolet emitting lamp 11 is then irradiated on the inks on the medium 20 to further cure the inks.

The ultraviolet emitting lamp 11 may be one selected from UV-LED lamps, metal-halide lamps, black light lamps, germicidal lamps, xenon lamps, and combinations of these lamps. A range of ultraviolet wavelengths when using a UV-LED lamp is, for example, 350 nm to 420 nm. An amount of ultraviolet irradiation is preferably decided within such a range of values that allows curing of the inks on the medium 20 to a smearing-preventable extent (semi-cured).

Through ultraviolet irradiation by the ultraviolet emitting lamp 11, the inks are preferably cured until their degrees of viscosity are equal to or greater than 200 mPa·sec. and equal to or less than 5,000 mPa·sec. The ink viscosity equal to or greater than 200 mPa·sec. provides the following advantages; smearing of the inks is prevented, and ink droplets on the medium 20 are spread enough to flatten the surface of a print. The ink viscosity equal to or less than 5,000 mPa·sec. can more effectively prevent smearing of the inks.

[Warm/Hot Air Heater 9]

The warm/hot air heater 9 for heating the inks on the medium 20 is located on the downstream side in the direction of transfer of the medium 20 relative to the ultraviolet emitting lamp 11. The warm/hot air heater 9 blasts hot air onto the inks on the medium 20 to volatilize the solvents still left in the inks heated by the print-heater 6.

[After-Heater 7]

The after-heater 7 for heating the inks on the medium 20 is located on the downstream side in the direction of transfer of the medium 20 relative to the print-heater 6. The after-heater 7 heats the inks on the medium 20 to volatilize the solvents still left in the inks heated by the print-heater 6.

[Ultraviolet Emitting Lamp 12]

An ultraviolet emitting lamp 12 is installed adjacent to the warm/hot air heater 9 in the direction indicated by arrow X. This ultraviolet emitting lamp is intended to further cure the inks by irradiating ultraviolet on the solvent-volatilized inks heated by the after-heater 7 and the warm/hot air heater 9.

After the inks on the medium 20 are heated by the after-heater 7 and the warm/hot air heater 9 and the solvents contained therein are thereby volatilized, the transferring roller is driven to transfer the medium 20 in the direction indicated by arrow X. Then, ultraviolet emitted from the ultraviolet emitting lamp 12 is irradiated on the inks on the medium 20 to fully cure the inks.

The ultraviolet emitting lamp 12 may be one selected from UV-LED lamps, metal-halide lamps, black light lamps, germicidal lamps, xenon lamps, and combinations of these lamps. A range of ultraviolet wavelengths when using a UV-LED lamp is, for example, 350 nm to 420 nm. An amount of ultraviolet irradiation is suitably decided within such a range of values that allows the inks on the medium 20 to be fully cured.

In the inkjet printing device 100, the inkjet heads 2 to 5 that respectively discharge the inks in different colors are aligned in the direction of transfer. The inkjet heads 2 to 5 thus aligned in the direction of transfer discharge the respective inks in a sequential order on the medium 20 while being transferred. While one of the inkjet heads (for example, inkjet head 2) is discharging its ink on the medium 20, the ink discharged and adhered to the medium 20 is heated by the print-heater 6. When another one of the inkjet heads (for example, inkjet head 3) starts to discharge its ink on the medium 20, the ink previously discharged and adhered to the medium 20 has already been thickened to a given or higher degree of viscosity. This ink, therefore, has no chance of smearing. When the ink is discharged on the medium 20 through another one of the inkjet heads, therefore, bleeding between colors of the inks does not occur. Besides, heating the medium 20 by the print-heater 6 serves to thicken the ink discharged later to a given or higher degree of viscosity before smearing of the ink starts. Thus, smearing of the inks discharged on the print medium 20 is effectively prevented.

When the black ink, which becomes particularly noticeable if smeared, is discharged through the inkjet head 5 on the downstream side in the direction of transfer, any other color inks on the medium 20 have already been increased in viscosity to a smearing-preventable extent. Therefore, there is no risk of bleeding between black and other colors of the inks, leading to improvements in a print quality.

Thus, possible bleeding between colors of the inks on the medium 20 is well-controlled, and a printing speed can be accordingly improved even with inks slow to dry.

By effectively preventing smearing of the inks discharged on the medium 20, the inks on the medium 20 can provide a high-quality print.

[Inkjet Printing Method]

An inkjet printing method using the inkjet printing device 100 is hereinafter described. The inkjet printing method according to the embodiment includes: a transfer step of transferring the medium 20; a print step of discharging an ink on the medium 20 through an inkjet head to carry out a print job; a first heating step of heating the medium 20 facing a region where the ink is discharged through the inkjet head; and a second heating step of heating the ink discharged on the medium 20 transferred subsequent to the first heating step, wherein a plurality of inkjet heads is provided as the inkjet head, and the plurality of inkjet heads discharges the inks in different colors and is aligned in a direction of transfer of the medium 20.

[Transfer Step]

The transferring roller of the inkjet printing device 100 is driven to transfer the medium 20 in a direction indicated by arrow X (transfer step).

[Print Step]

The inkjet heads 2 to 5 discharge inks on the medium 20 to print an object thereon (print step). The inkjet heads 2 to 5 respectively discharge the inks in different colors and are aligned in the direction of transfer of the medium 20, so that the different color inks can be discharged, on each at a time, on the medium 20.

[First Heating Step]

The print-heater 6 heats the medium 20 facing the region where the inks are discharged through the inkjet heads 2 to 5 (first heating step). To prevent smearing of the inks discharged on the medium 20, preferably, the first heating step is performed concurrently with the print step, or the first heating step starts to be performed before the print step starts and continues until the print step is over. By irradiating ultraviolet on the inks on the medium 20 from the ultraviolet emitting lamps 10 respectively installed in the inkjet heads 2 to 5, the different color inks are semi-cured, one each at a time, to a smearing-preventable extent. As far as the inks can be thickened by the first heating step to a degree of viscosity high enough not to smear, further cure of the inks by the ultraviolet emitting lamps 10 may be unnecessary.

Subsequent to the first heating step, the ultraviolet emitting lamp 11 irradiates ultraviolet on the inks on the transferred medium 20 to further cure the inks. As far as the inks can be thickened by the first heating step to a degree of viscosity high enough not to smear, further cure of the inks by the ultraviolet emitting lamp 11 may be unnecessary.

[Second Heating Step]

Subsequent to the ultraviolet irradiation by the ultraviolet emitting lamp 11, the inks on the transferred medium 20 are heated by the after-heater 7 and the warm/hot air heater 9 (second heating step). The second heating step is performed to fully evaporate the solvents contained in the inks on the medium 20. Then, ultraviolet emitted from the ultraviolet emitting lamp 12 is irradiated on the inks on the medium 20, and the inks on the medium 20 are thereby fully cured.

The inkjet printing method according to the embodiment can effectively control smearing of the inks on the print medium, thereby providing a high-quality print.

Modified Example

Figure 2:
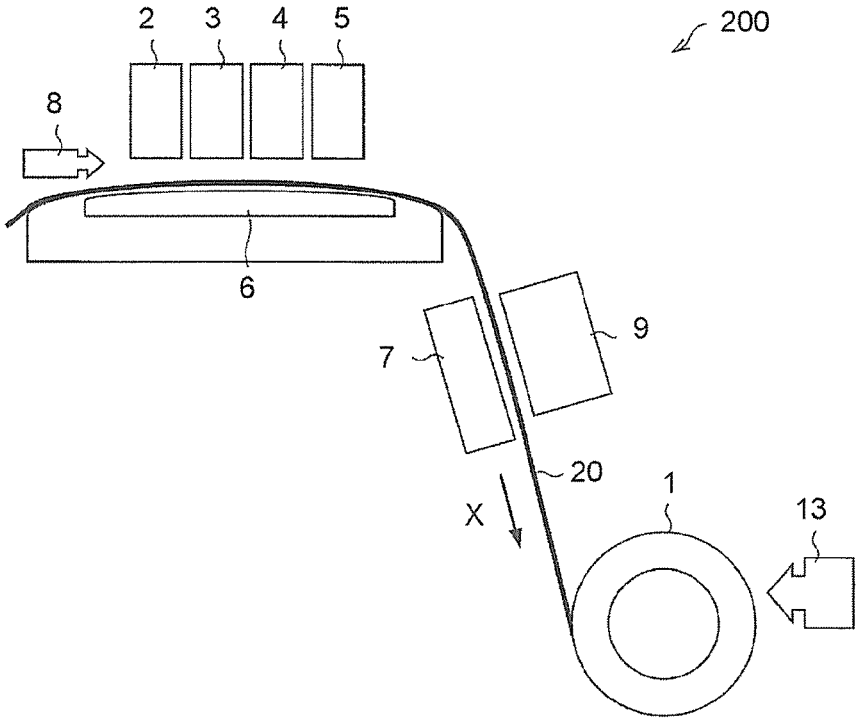
FIG. 2 is a drawing of an inkjet printing device according to a modified example of the embodiment.

A modified example of the embodiment is described below referring to FIG. 2. FIG. 2 is a drawing of an inkjet printing device according to the modified example of the invention. An inkjet printing device 200 according to the modified example is not equipped with the ultraviolet emitting lamps 10 to 12 but with a cooling fan 13, which is a difference to the inkjet printing device 100 according to the embodiment described earlier.

Instead of the ink containing a solvent and cured by radiation irradiated thereon (solvent UV ink), the inkjet printing device 200 according to the modified example uses a solvent ink, an aqueous ink, or a latex ink.

[Solvent Ink, Aqueous Ink]

The ink used in the inkjet printing device 200 according to the modified example may be a solvent ink containing any solvent but water or an aqueous ink containing water. The solvent contained in the solvent ink may be the same solvent as contained in the solvent UV ink.

[Latex Ink]

The ink for the inkjet printing device 200 according to the modified example may be a latex ink containing water or an organic solvent and a resin in which the resin is emulsified or suspended in the organic solvent or water.

An aqueous latex ink in which a resin is emulsified or suspended in water may as well be said to contain an aqueous emulsion or an aqueous suspension formed by the resin.

Examples of the resin are water-soluble vinyl-based resins, acrylic resins, alkyd-based resins, polyester-based resins, polyurethane-based resins, silicon-based resins, fluororesins, epoxy-based resins, phenoxy-based resins, polyolefin-based resins, and modified resins obtained from these resins. Of these examples, acrylic resins, water-soluble polyurethane-based resins, water-soluble polyester-based resins, and water-soluble acrylic resins are preferably used, and acrylic resins are particularly preferable. The resin contained in the aqueous latex ink may be a resin solely used, or two or more different resins may be combined and used. The resin content in the aqueous latex ink may be optionally decided depending on the type of the used resin. For example, the resin content is preferably equal to or greater than 1 wt. %, and more preferably equal to or greater than 2 wt. % for the whole quantity of the aqueous latex ink. Also, the resin content is preferably equal to or less than 20 wt. %, and more preferably equal to or less than 10 wt. % for the whole quantity.

The latex ink is curably by drying or heating. The latex ink is advantageously unlikely to merge into images printed with inks of any other types. Such an advantage makes the latex ink useful as a protective ink. Therefore, the inkjet printing device 200 using the latex ink is advantageous in that more time is available for smoothing, providing a print with a better smoothed surface. Another advantage of the latex ink is its applicability to various kinds of print media.

The latex ink may further contain an emulsifier for emulsifying or suspending the resin.

The organic solvent or water of the latex ink may additionally contain another resin dissolved therein in addition to the emulsified or suspended resin. This additional resin may be dissolved in the organic solvent or water to adjust the viscosity of the ink. After the ink is dehydrated by drying, particles of the emulsified or suspended resin are bonded to form a film. At the time, the additional resin may serve as a binding material that further strengthens the bond between the particles of the emulsified or suspended resin.

[Cooling Fan 13]

The cooling fan 13 blasts air onto the medium 20 heated by the after-heater 7 and the warm/hot air heater 9 to cool the medium 20 and the inks on the medium 20.

In any of the solvent ink, aqueous ink, or latex ink used in the inkjet printing device 200, the solvent contained therein can be evaporated well to prevent smearing of the ink. In the case of reciprocating the inkjet heads to obtain a print, these heads discharge the inks in the same sequential order, meaning that the order of printed colors remains unchanged. The device thus advantageous excels in constant color reproducibility.

Second Embodiment

Figure 3:
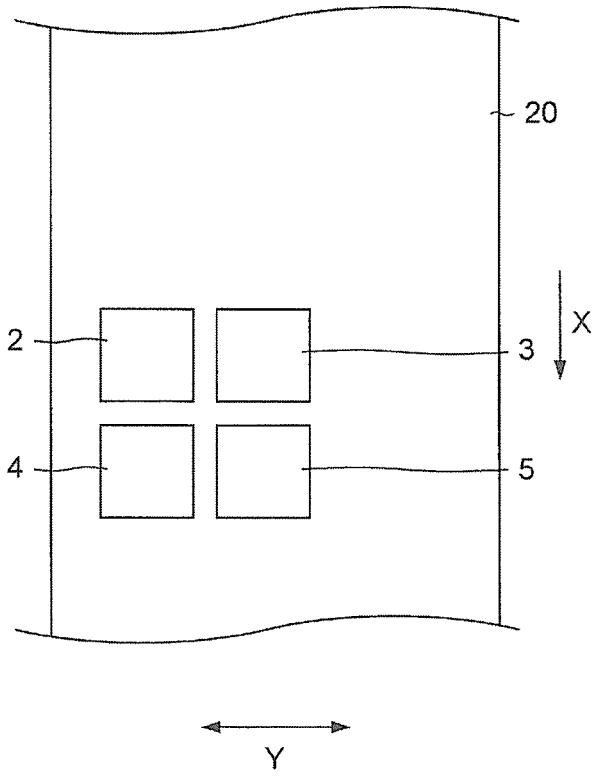
FIG. 3 is a drawing of an inkjet printing device according to another embodiment of the invention.

An inkjet printing device according to another embodiment of the invention is hereinafter described. FIG. 3 is a drawing of the inkjet printing device according to the embodiment of the invention. The same structural elements as those described in the first embodiment are illustrated with the same reference numerals and not described again.

In the inkjet printing device according to the embodiment, the inkjet heads 2 to 5, facing the medium 20, move in a direction intersecting the direction of transfer. As illustrated in FIG. 3, the device has four inkjet heads. Two of the four inkjet heads are aligned in the direction intersecting the direction of transfer (direction indicated by arrow Y in the drawing), while the other two inkjet heads are respectively located on the upstream side in the direction of transfer relative to the two inkjet heads aligned in the intersecting direction.

The yellow and black inks are discharged through two inkjet heads 4 and 5 on the downstream side in the direction of transfer of the medium 20.

By disposing two of the inkjet heads in the direction intersecting the direction of transfer, the serial head inkjet printing device can be compactly structured as compared to disposing plurality of the inkjet heads along the direction of transfer.

The invention is not necessarily limited to the embodiment described so far and may be carried out in many other forms. The technical scope of the invention encompasses any modifications within the scope of the invention defined by the appended claims and embodiments obtained by variously combining the technical means disclosed herein.

[Additional Points]

As described thus far, the inkjet printing device 100 includes: the transferring roller for transferring the medium 20; the inkjet heads that respectively discharge inks on the medium 20 to carry out a print job; the print-heater 6 for heating the medium 20, the print-heater 6 being disposed so as to face the region where the inks are discharged through the inkjet heads with the medium 20 interposed therebetween; and the after-heater 7 for heating the inks discharged on the medium 20, the after-heater 7 being installed on the downstream side in the direction of transfer of the medium 20 relative to the print-heater 6, wherein the plural inkjet heads respectively discharge the inks in different colors and are aligned in the direction of transfer.

The inkjet heads 2 to 5 that discharge the different color inks are aligned in the direction of transfer. The inkjet heads 2 to 5 thus aligned in the direction of transfer discharge the respective inks in a sequential order on the medium 20 while being transferred. While one of the inkjet heads is discharging its ink on the medium 20, the ink discharged and adhered thereto is heated by the print-heater 6. When another one of the inkjet heads starts to discharge its ink on the medium 20, the ink previously discharged and adhered to the medium 20 has already been thickened to a given or higher degree of viscosity. This ink, therefore, has no chance of smearing. When the ink is discharged on the medium 20 through another one of the inkjet heads, therefore, bleeding between colors of the inks does not occur. Besides, heating the medium 20 by the print-heater 6 serves to thicken the ink discharged later to a given or higher degree of viscosity before smearing of the ink starts. In this manner, smearing of the inks discharged on the medium 20 is effectively prevented.

By effectively preventing smearing of the inks discharged on the medium 20, the inks on the medium 20 can provide a high-quality print.

The inkjet printing device 100 is further characterized in that, of the plurality of inkjet heads 2 to 5, the inkjet heads that discharge the inks in any colors but black are arranged from the upstream side toward the downstream side in the direction of transfer, so that the inks in different colors are discharged through the heads in the order of lower clarity.

The plural inkjet heads discharge the inks in any colors but black in the order of lower clarity from the upstream side toward the downstream side in the direction of transfer of the print medium. Therefore, the inks of higher clarity are discharged on the inks of lower clarity. This prevents that incident light is reflected or absorbed by an ink surface alone, allowing the inks to exhibit their colors more vividly.

The inkjet printing device 100 is further characterized in that the plurality of inkjet heads 2 to 5 is at least four inkjet heads that are aligned along the direction of transfer, and the four inkjet heads 2 to 5 are arranged from the upstream side toward the downstream side in the direction of transfer so as to respectively discharge cyan, magenta, yellow, and black inks in a sequential order.

The inkjet printing device 100 thus characterized discharges the different color inks except the black ink in the order of lower clarity. This allows the inks to exhibit their colors more vividly. The plural inkjet heads 2 to 5 may be spaced at intervals optionally decided depending on such factors as transfer speed of the print medium, types of used inks, type of the print medium, heating temperatures, and environmental temperature.

The inkjet printing device 100 is further characterized in that the plurality of inkjet heads 2 to 5, facing the medium 20, moves in the direction intersecting the direction of transfer, the inkjet heads are at least four inkjet heads, two of the four inkjet heads are aligned in the direction intersecting the direction of transfer, the other two inkjet heads are located on the upstream side in the direction of transfer relative to the two inkjet heads aligned in the intersecting direction, and the two inkjet heads on the downstream side in the direction of transfer respectively discharge the yellow and black inks.

By disposing two of the inkjet heads in the direction intersecting the direction of transfer, the serial head inkjet printing device 100 can be compactly structured as compared to disposing plurality of the inkjet heads 2 to 5 along the direction of transfer.

The inkjet printing method includes: the transfer step of transferring the medium 20; the print step of discharging the inks on the medium 20 through the inkjet heads to carry out a print job; the first heating step of heating the medium 20 facing the region where the inks are discharged through the inkjet heads; and the second heating step of heating the inks discharged on the medium 20 transferred subsequent to the first heating step, wherein the plural inkjet heads 2 to 5 respectively discharge the inks in different colors and are aligned in the direction of transfer of the medium 20.

This inkjet printing method provides similar technical advantages to those provided by the inkjet printing device 100.

INDUSTRIAL APPLICABILITY

The invention is advantageously applicable to inkjet printing.

The invention claimed is:

1. An inkjet printing method, using an inkjet printing device at least comprising:

a transferring unit for transferring a print medium;

an inkjet head for discharging an ink which contains a solvent on the print medium to carry out a print job, and the inkjet head faces the print medium and reciprocating moves in a direction intersecting a direction of transfer; and a print-heater for heating the print medium at temperatures equal to or higher than 30° C. and equal to or lower than 90° C. when discharging the ink so as to evaporate the solvent and increase a viscosity of the ink, and the print-heater being disposed so as to face a region where the ink is discharged through the inkjet head with the print medium interposed therebetween;

wherein, in the inkjet printing method, a plurality of inkjet heads as the inkjet head, the plurality of inkjet heads each discharges one type of color among the inks in different colors and the inkjet heads that discharge the inks in any colors but black are arranged from an upstream side toward a downstream side in the direction of transfer, so that the inks in different colors are discharged through the inkjet heads in the order of lower clarity, the inkjet heads that discharge the inks in any colors but black are arranged spaced from the inkjet head that discharges the ink in black by a distance, the inks discharged from the inkjet heads arranged at the upstream side and adhered to the print medium become a given or higher degree of viscosity, after that, the inks are discharged from the inkjet heads arranged at the downstream side, so as to inhibit bleeding between colors, and in the inks except the black ink, the inks of higher clarity are discharged on the inks of lower clarity, wherein the plurality of inkjet heads is at least four inkjet heads that are aligned along the direction of transfer, and the four inkjet heads are arranged from the upstream side toward the downstream side in the direction of transfer, so as to respectively discharge cyan, magenta, yellow, and black inks in a sequential order.

* * * * *